United States Patent [19]

Wakeman

[11] 4,182,214

[45] Jan. 8, 1980

[54] ELECTRONIC MUSICAL INSTRUMENT

[75] Inventor: Richard C. Wakeman, Farnham, England

[73] Assignee: Birotronics Ltd., England

[21] Appl. No.: 872,899

[22] Filed: Jan. 27, 1978

[30] Foreign Application Priority Data

Feb. 10, 1977 [GB] United Kingdom ..... 5484/77

[51] Int. Cl.[2] ..... G10H 3/04; G10G 3/04

[52] U.S. Cl. ..... 84/1.28; 84/DIG. 29; 84/461

[58] Field of Search ..... 84/1.01, 1.02, 1.03, 84/1.28, 461, 462, DIG. 29; 360/92

[56] References Cited

U.S. PATENT DOCUMENTS

| | | | |
|---|---|---|---|
| 2,940,351 | 6/1960 | Chamberlin | 84/1.28 |
| 3,193,608 | 7/1965 | Bobis | 84/1.28 |
| 3,250,847 | 5/1966 | Chamberlin | 84/1.28 |
| 4,018,127 | 4/1977 | Biro | 84/DIG. 29 |

*Primary Examiner*—Gene Z. Rubinson
*Assistant Examiner*—William L. Feeney
*Attorney, Agent, or Firm*—Jacobs & Jacobs

[57] ABSTRACT

An electronic musical instrument, in the nature of an organ, employs a plurality of endless magnetic tape cartridges, each continuously playing an endless magnetic tape stored therein, each endless tape having recorded thereon a continuous tone, and a keyboard arranged such that depression of a key causes the output of a selected tape cartridge to be played through a speaker system continuously for as long as the key is depressed.

2 Claims, 5 Drawing Figures

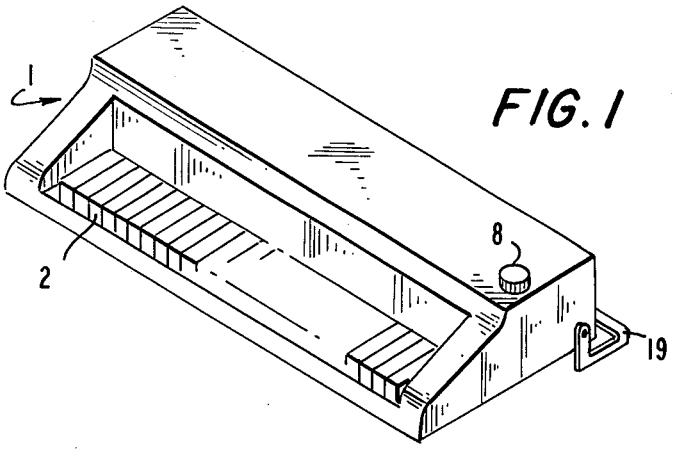
FIG. 1
FIG. 2
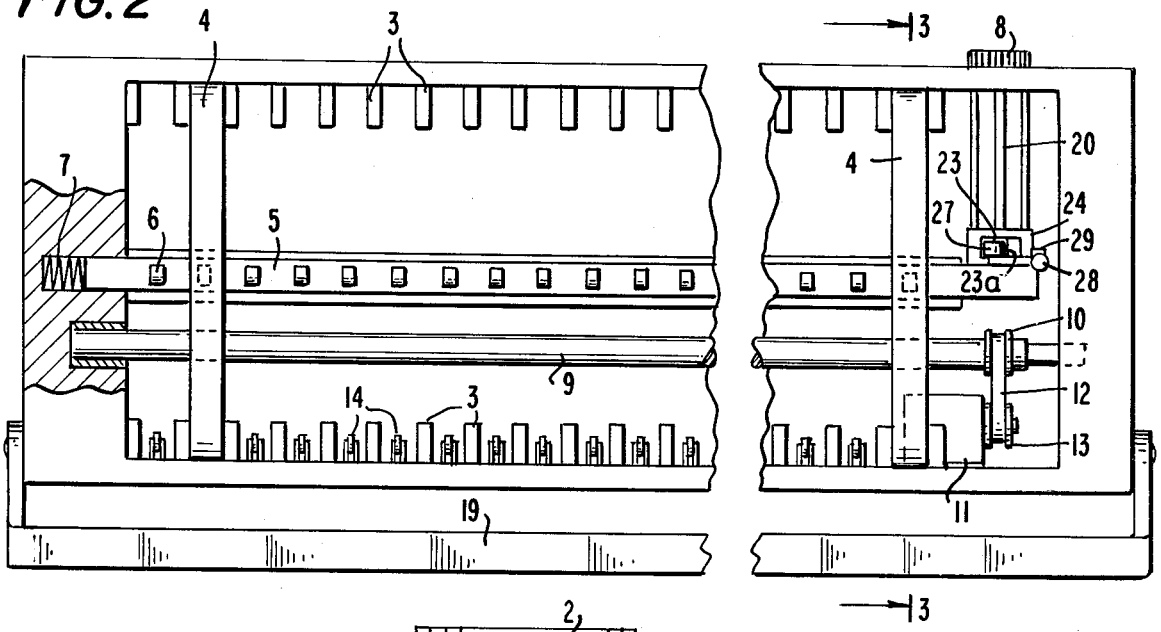
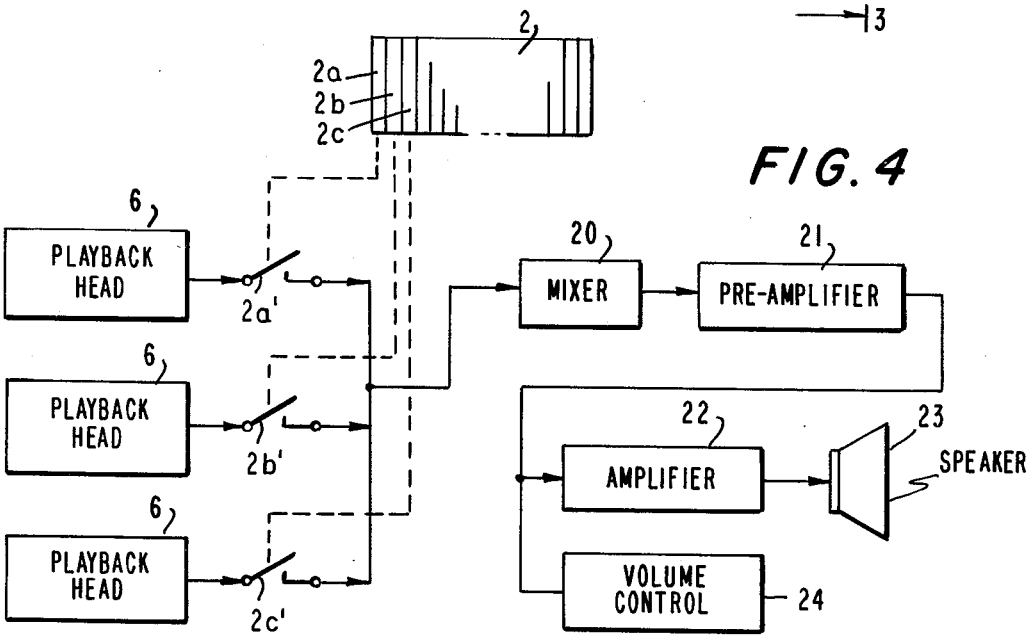
FIG. 4

ELECTRONIC MUSICAL INSTRUMENT

The present invention relates to an electronic musical instrument.

Electronic musical instruments generally fall into two classes. First are the electronic organs, and the like, that produce sound synthetically, such as through oscillators, and the like. While the range of these instruments is quite remarkable, nevertheless there is still a need for an instrument capable of faithfully reproducing the actual sound of the desired instrument.

The second class is the electronic instrument that plays back the sound information recorded on a magnetic tape. These instruments store a plurality of short lengths of magnetic tape that are selectively played back when a button, or the like, is depressed. While these instruments do reproduce the actual sound of an instrument or human voice, nevertheless they have been quite complex, and once programmed with a given set of tracks, it is very difficult to add or change tapes. Also, there is a time lag between the time a button or key is depressed and the tape is transported past the playback head to be played back. Furthermore, the tapes are of relatively short length and it may occur that a given sound must be played back for a longer interval than is provided for on the tape.

These problems are solved by the present invention, which provides a new musical instrument comprising a plurality of endless magnetic tape cartridges, each holding an endless tape on which a desired sound is recorded. When the cartridge is inserted into the musical instrument of the invention, the tape in the cartridge is transported past an associated playback head to continuously play back the sound information on the tape and thereby continuously produce an output signal. A plurality of playback heads, one for each cartridge, are mounted on a common support, which is preferably movable. A single capstan is provided to transport the tapes in the cartridges. Connected in series with the playback head, an amplification system and a speaker is a normally open switch located under a given key or button of a keyboard. When a key or button is depressed, the switch is closed, thereby allowing the output signal to be amplified, and the desired sound is emitted from the speaker. Indeed, the sound continues to be emitted from the speaker indefinitely as long as the key is depressed, since the magnetic tape carrying the recorded sound information is endless. To stop the sound, the depressed key is released and spring operation, or the like, causes the depressed key or button to be restored to its initial raised position, as in a piano or accordion, and the closed switch is thereby allowed to move back to its normally open position.

The present invention is illustrated by the accompanying drawings, in which:

FIG. 1 is a perspective view of the electronic musical instrument of the invention;

FIG. 2 is a rear view of the musical instrument of the invention;

Figure 3:
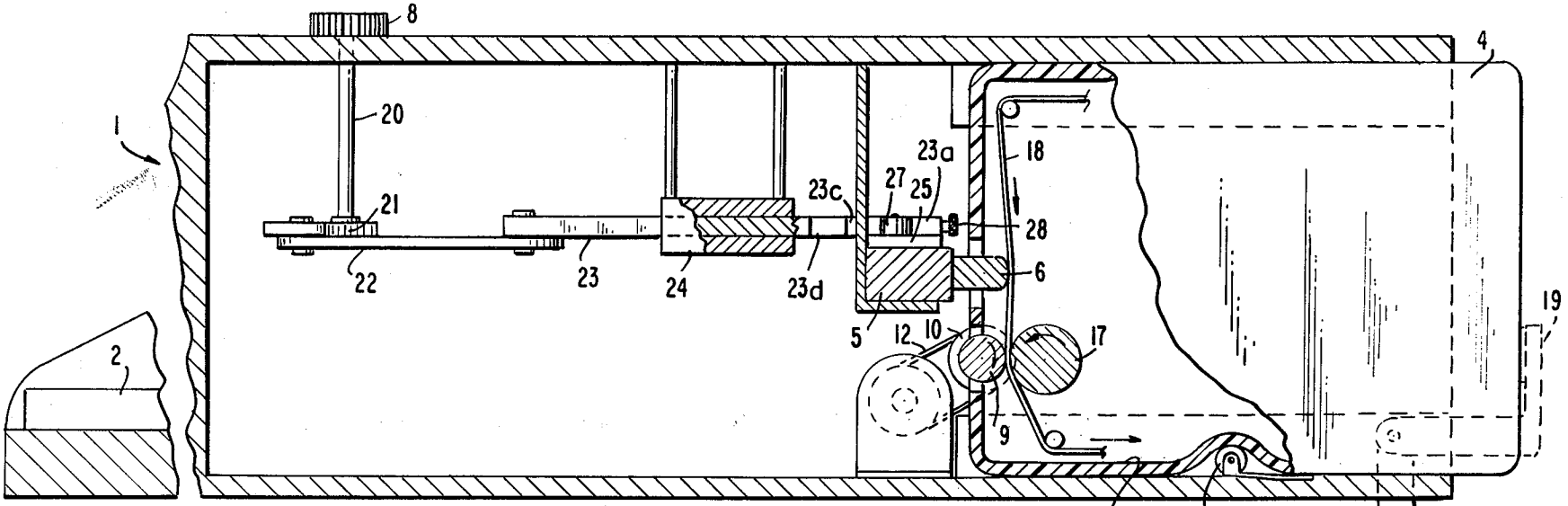
FIG. 3 is a view, partly in section, along lines 3—3 of FIG. 2.
Figure 3A:
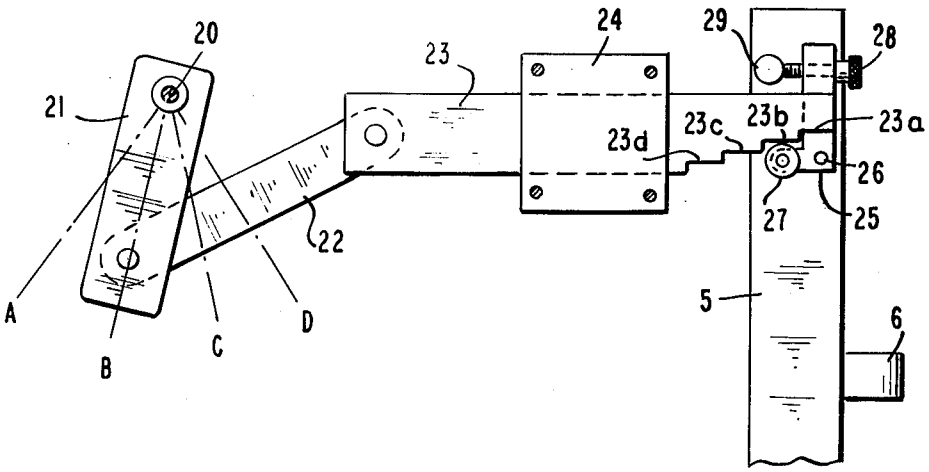

FIG. 3*a* is a detail view in enlarged scale; and

FIG. 4 is a block diagram of the operation of the electronic musical instrument.

FIG. 1 shows an instrument according to the invention in the form of an electronic organ 1 having a keyboard 2 having a plurality of keys 2*a*, 2*b*, 2*c*, etc.

As shown in FIG. 2, the organ 1 has a plurality of cartridge guides 3 that receive between them a plurality of endless magnetic tape cartridges 4, two of which are shown. Slide 5 carries a plurality of playback heads 6, one for each magnetic tape cartridge 4 that can be inserted into the organ 1. Slide 5 is biased by spring 7 to the right as viewed in FIG. 2 in cooperation with the track-change mechanism, which will be described in detail hereinafter. Capstan 9 is journalled in the side walls of the organ 1 and carries a pulley 10 at one end. Motor 11 drives capstan 9 by having belt 12 trained over capstan pulley 10 and motor pulley 13. Motor 11 is powered via an electrical connection (not shown) to a power source.

As shown in FIG. 3, when a magnetic tape cartridge 4 is inserted into the organ 1 between a pair of guides 3, a spring-loaded roller 14 will ride along edge 15 of the tape cartridge until the roller 14 is urged by spring force into notch 16, whereupon cartridge 4 is indexed in the play mode. Cartridge 4 is of conventional construction and has a pinch roller 17 that engages capstan 9 when the cartridge 4 is in the play mode, thereby transporting the endless magnetic tape 18 across the playback head 6. Tape 18 is coiled in a spiral (not shown) with the tape being uncoiled from the center of the coil and rewound into the outside, as is known. When all of the desired number of cartridges are inserted, the retainer 19 is flipped up to the dotted position shown in FIG. 3 to insure that the tape cartridges are held in place. The retainer 19 is manually returned to the solid line position against the action of a spring (not shown).

Playback head 6 is a conventional magnetic head used to transduce magnetic tape. When tape 18 is transported across playback head 6, an output signal is generated. For a given performance, as many tape cartridges 4 as will be needed are put into the play mode by inserting the tape cartridges 4 into the organ until the rollers 14 engage the notches 16. In the embodiment shown in FIG. 2, two tape cartridges 4 are in the organ, but in practice at least will be used. It is a feature of this invention that every tape cartridge in the play mode continuously plays back the sound information recorded thereon.

In a simplified embodiment of the invention, single track tape cartridges are used, each tape having recorded thereon a different note. Thus, two different notes can be sounded by the embodiment shown in FIG. 2, one for each cartridge 4 in the play mode.

FIG. 4 is a diagrammatic illustration of how the notes are sounded. In FIG. 4 only three playback heads are shown, the others being omitted for simplicity. The three playback heads 6 shown in FIG. 4 are each associated with a tape cartridge 4 in the play mode, and hence each continuously produces an output signal upon playback of the sound information on its associated tape. The signal is sent to a mixer 20, preamplifier 21, amplifier 22 and a speaker 23 to produce an audible signal of desired volume. Volume control 24 is a potentiometer or the like. Between the playback heads 6 and mixer 20 are switches 2*a*′, 2*b*′, 2*c*′, etc., there being one switch for each playback head 6. Each switch has an actuator that is urged to the normally open position. Each switch is mechanically connected to a key 2*a*, 2*b*, 2*c*, etc. of the keyboard by locating the switch actuator under the key 2*a*, 2*b*, 2*c*, etc. As many sounds will be heard from speaker 23 as there are keys depressed. As soon as a key is released, it moves by spring action to its initial position and, likewise, the associated switch automatically returns to the open position.

There need be only one key 2*a*, etc. for each switch 2*a'*, etc. In a given case, all or only some of the keys will produce a sound. In the device shown in FIG. 2, the keyboard 2 will have a number of "dead" keys, since only two tape cartridges 4 are used.

Normally, the keys in the keyboard will progress note-by-note in scales, as in a piano, but it may be desirable in some cases to arrange the notes in other patterns. Similarly, the first key on the keyboard may or may not be associated with the tape player in the left-most position of the top row (FIG. 1). All that is necessary is that the performer be aware of the note sounded by each key.

It is preferred to use multi-track tapes, and preferably 8-track tapes, commonly known as STEREO-8 tapes, so as to obtain more capability from the instrument. When 8-track tapes are used, the tracks of a given tape are paired, with tracks 1 and 2, 3 and 4, 5 and 6, and 7 and 8 being the left and right channels, respectively, of four paired tracks, which can be designated Tracks A, B, C and D. When a playback head player is playing Track A, two separate outputs are simultaneously produced, one for the left stereo channel and one for the right. Hence, by using 8-track stereo tapes, eight notes per tape can be stored as four pairs of notes. The 8-track tapes are used to best advantage by using both channels of all tracks. Hence, the outputs from the left and right channels of Track A are associated with two keys of the keyboard, each output being sent to the switch associated with the desired key. For example, key 2*a* and switch 2*a'* can be associated with the left channel of Track A of a tape and key 2*b* and switch 2*b'* with the right channel of Track A of that tape.

To minimize undesired sounds arising from leakage from channel to channel, the left and right channels of a given tape preferably have recorded thereon complementary notes, such as fourths, fifths, octaves, etc., although there may be cases where dissonance is not only tolerated but even desired.

To move the playback heads 6 from one track to another, the track-change dial 8 is moved to the indicium (not shown) designating the desired track. In a conventional 8-track cartridge, four indicia will appear and the dial 8 will be movable to one of four positions.

Dial 8 is connected to shaft 20, which is in turn connected to linkage 21 (FIG. 3*a*). Linkage 22 is pivotally connected to linkage 21 at one end and to slide 23 at the other. Slide 23 is mounted for reciprocal sliding movement in guide 24, and has four steps 23*a*, 23*b*, 23*c* and 23*d* corresponding to the four tracks on the tape.

Slide 5 has at the end opposite spring 7, a lever 25 pivotally mounted on shaft 26, which is fixed to slide 5. At one end of lever 25 is a roller 27 and at the other end is a spring-loaded adjustment screw 28 that bears against a post 29 fixed to slide 5.

Slide 23 lies above lever 25 so that roller 27 directly contacts one of the steps 23*a-d*. By turning the adjustment screw 28 in or out, the lever 25 is pivoted about shaft 26 to change the distance between roller 27 and the steps 23*a-d* on slide 5. In the position shown, roller 27 is on step 23*b*, which corresponds to track B, as shown by the dotted lines (FIG. 3*a*) representing the four positions of dial 8 and linkage 21. To change the heads 6 to track C, the dial 8 is rotated to move linkage 21 to position C, thus moving slide 23 to the right as viewed in FIG. 3*a*. This will cause roller 27 to ride up to step 23*c* against the bias of spring 7, and slide 5 will move downwardly as viewed in FIG. 3*a* so that heads 6 are moved to Track C. Heads 6 can be moved to track A by rotating dial 8 in the opposite direction, causing slide 5 to move leftwardly, whereby roller 27 will ride down to step 23*a* under the bias of spring 7. Dial 8 is provided with a suitable click-stop mechanism (not shown) so that there is positive indexing of the dial at each of its positions.

The sound information carried on the tape is any sound that is normally sustained, such as the sound made by brasses, woodwinds, strings, pipe organs, the human voice, or even synthesized sound. Instruments that are plucked would not normally be suitable for recording, such as an acoustic guitar and harpsichord. A given sound produced by depressing a given key may be a single note, or two or more different notes, sounded by one or more of the same or different instruments and/or human voice, as recorded on that track corresponding to the given key. For example, a group of violins and cellos sounding a note or a chord may be more pleasant or desired than a single violin or cello sounding the same note or chord. A flute and human voice may also be a desired combination for recording a tone on a track. Even an entire orchestra could be used.

An advantage of using multi-track tapes, and preferably 8-track stereo tapes, is the ability to store on one tape the sounds of more than one instrument. For example, four cartridges each having eight notes of four different instruments, namely on Tracks A, B, C and D, can give one octave per cartridge for four instruments. Track-changing dial 8 changes all of the playback heads 6 on slide 5 simultaneously from a given track to another. Of course, when single track tapes are employed, spring 7 and the track changing device may be omitted. By proper choice of tapes and tracks, the operator of the electric organ 1 can sound one or more notes of one or more instruments. These notes can be played in or out of harmony, as desired. Alternatively, more than one keyboard 2 can be provided, as in a pipe organ, so that a wide range of instrumental sounds can be at the fingertips of the operator. Indeed, even sound effects, white noise, static, or any other sustained sound, can be stored on a tape and played back. One or more players could be used to store a pre-recorded program on one or more tracks, so that the operator could practice or play along with the program.

Normally, an organ 1 will be supplied with a keyboard designed for use with a given set of cartridges 4 to be inserted into the organ 1 in a given array. Replacement of a defective tape cartridge is independent of the remaining tape cartridges. 8-track tape cartridges, such as described in U.S. Pat. Nos. 3,403,868 and 3,437,762 and U.S. Reissue Pat. No. 27,885, are readily commercially available.

Further, the entire program for the organ 1 can be changed merely by substitution of tape cartridges 4. Thus, if all of the tape cartridges 4 carry tapes that on all tracks provide sounds of a pipe organ, one or more octaves thereof can be replaced with the sounds of woodwinds, etc. merely by changing the desired number of pipe organ cartridges for woodwind cartridges. The potential for the system is limited only by the imagination of the operator.

It is a feature of this invention that each tape cartridge immediately produces an output signal when the cartridge is inserted into the organ in the play mode.

What is claimed is:

1. A musical instrument comprising:

(a) a longitudinally extending housing;

(b) guide means in said housing for indexing a plurality of magnetic tape cartridges in a predetermined side-by-side longitudinally extending relationship in which all of the indexed tape cartridges are adapted to be played, each indexed tape cartridge containing an endless magnetic tape having a plurality of tracks of sound intelligence recorded thereon;

(c) a playback head support extending longitudinally of the housing and slidably mounted therein for longitudinal movement, and a plurality of playback heads mounted on said support and operable continuously to transduce magnetic tape transported thereacross and thereby continuously produce an output signal;

(d) a common capstan mounted for rotation in the housing and operable to engage the pinch rollers of each tape cartridge indexed in said guide means for transporting said magnetic tape in each said indexed cartridge across said playback heads, there being a playback head for each indexed cartridge;

(e) track changing means operable to slide said playback head support longitudinally to move said playback heads across said tapes in said indexed tape cartridges from track to track, said track changing means comprising a roller carried by said support, a slide member arranged for reciprocal sliding movement transversely across said support and having a plurality of steps corresponding to the tracks on a tape at one end thereof, spring means biasing said support in a direction urging said roller into contact with said steps, and operating means for sliding said slide across said support, said roller being operable to ride up the steps against the bias of said spring means when the slide is moved in one direction and to ride down the steps under the action of said spring means when the slide is moved in the opposite direction;

(f) audio means connected to said playback heads for mixing said output signals and audibly broadcasting said mixed output signals; and (g) manually operated keyboard means having a plurality of keys for selecting the sound information of a desired track of a desired tape, said keys being movable between a normally raised position and a depressed position, and a plurality of normally open switch means operated by said keys to remain closed for as long as a key associated with a switch means is manually held in the depressed position and to open when the key moves to the raised position, there being a key for each switch means and a switch means connected in circuit with each said playback head and said audio means, said audio means being operable continuously to broadcast an audible tone corresponding to the sound intelligence on the tapes selected by depressing one or more of said keys for as long as said keys are depressed.

2. The musical instrument according to claim 1, wherein each endless magnetic tape has four tracks having sound information recorded thereon, each track being capable of carrying two different sound informations, each said playback head being operable, independently of the other playback heads, continuously to produce two output signals corresponding to the two sound informations on each track being transduced.

* * * * *